US009022219B2

(12) United States Patent
Baker

(10) Patent No.: US 9,022,219 B2
(45) Date of Patent: May 5, 2015

(54) SUSPENSION MAGNET

(76) Inventor: William John Baker, Thirroul (AU)

( * ) Notice: Subject to any disclaimer, the term of this patent is extended or adjusted under 35 U.S.C. 154(b) by 197 days.

(21) Appl. No.: 13/641,991

(22) PCT Filed: Apr. 21, 2011

(86) PCT No.: PCT/AU2011/000470

§ 371 (c)(1),
(2), (4) Date: Jan. 4, 2013

(87) PCT Pub. No.: WO2011/130803

PCT Pub. Date: Oct. 27, 2011

(65) Prior Publication Data

US 2014/0144816 A1 May 29, 2014

(30) Foreign Application Priority Data

Apr. 22, 2010 (AU) ..... 2010201631

(51) Int. Cl.

| | |
|---|---|
| ***B03C 1/00*** | (2006.01) |
| ***B03C 1/22*** | (2006.01) |
| ***B03C 1/033*** | (2006.01) |
| ***B03C 1/18*** | (2006.01) |
| ***B03C 1/30*** | (2006.01) |
| ***H01F 7/02*** | (2006.01) |

(52) U.S. Cl.

CPC ..... *B03C 1/22* (2013.01); *B03C 1/0332* (2013.01); *B03C 1/0335* (2013.01); *B03C 1/18* (2013.01); *B03C 1/30* (2013.01); *H01F 7/0205* (2013.01)

(58) Field of Classification Search

USPC ..... 209/213, 215, 636

See application file for complete search history.

(56) References Cited

U.S. PATENT DOCUMENTS

| | | | | |
|---|---|---|---|---|
| 3,935,947 A * | 2/1976 | Barrett | ..... | 209/636 |
| 5,100,280 A * | 3/1992 | George, Jr. | ..... | 414/440 |
| 6,261,043 B1 * | 7/2001 | Weems et al. | ..... | 414/191 |

FOREIGN PATENT DOCUMENTS

DE 202004009188 U1 * 9/2004

* cited by examiner

*Primary Examiner* — Terrell Matthews

(74) *Attorney, Agent, or Firm* — Jansson Munger McKinley and Shape Ltd.

(57) ABSTRACT

A suspension magnet assembly (10) having a magnet (24) with an arcuate lower surface, and a collector (27) movable from adjacent the magnet (24) to a position spaced from the magnet (24) to provide for the removal of collected material (14) from the assembly (10).

19 Claims, 4 Drawing Sheets

SUSPENSION MAGNET

TECHNICAL FIELD

The present invention relates to suspension magnets and more particularly but not exclusively to suspension magnets employed in the mining industry to remove iron from mined material.

BACKGROUND OF THE INVENTION

Suspension magnets are placed over conveyor belts to remove iron from material passing by the magnets due to movement of the belt.

The magnets have included electromagnets as well as permanent magnets such as ferrite and rare earth permanent magnets.

In the case of electromagnets, disadvantages include limited depth of magnetic field and dangers associated with the device needing to be electrified.

Disadvantages in respect of the permanent magnets include difficulty in removing material collected.

A further disadvantage of the above discussed suspension magnets is that they can cause damage to the belt. The collected material can become "sandwiched" between the suspension magnet and the belt which results in the cutting or piercing of the belt.

OBJECT OF THE INVENTION

It is the object of the present invention to overcome or substantially ameliorate at least one of the above disadvantages.

SUMMARY OF THE INVENTION

There is disclosed herein a magnet assembly to collect iron from a conveyor belt, the assembly including:

a collector device including at least one magnet to be positioned adjacent the belt to collect iron therefrom, and wherein the collector device includes a collector having a downwardly convex arcuate surface to which the iron is attracted so as to be collected by the collector device, the collector being movable between a first position adjacent to the at least one magnet and a second position spaced from the first position away from the at least one magnet.

Preferably, the assembly includes:

a carriage movable between a first position and a second position;

the collector device is mounted on the carriage so as to move therewith, the collector device being supported so that when the carriage is in the first position the device is to be positioned adjacent the belt, while when located in the second position the collector device is to be spaced from the belt to provide for delivery of collected iron to a position spaced from the belt;

the collector is attached to the carriage and positioned relative to the magnet so as to be locatable between the magnet and the belt, the collector being essentially non-magnetic; and the collector device further includes:

a collector motor associated with the collector to cause movement of the collector between the first position where the collected iron is urged against the collector by the magnet so as to be retained by the assembly, and the second position where the collected iron is removed from the collector.

Preferably, said collector is of a domed configuration so as to be downwardly convex.

Preferably, said assembly includes a rail supporting said carriage, and a carriage motor operatively associated with the rail and carriage to cause movement of the carriage between the carriage first and second positions.

Preferably, said carriage is moved generally horizontally between the carriage first and second positions.

Preferably, said collector is located below said magnet.

Preferably, the collector motor causes movement of the collector in a generally vertical direction.

Preferably, said magnet is a permanent magnet.

Preferably, the collector motor is generally centrally mounted so that the magnet or magnets are arranged angularly about the motor.

Preferably, said assembly has a generally upright central longitudinal axis, about which the magnets are angularly arranged, with said axis passing generally centrally through said arcuate surface.

Preferably, the collector device includes a base, with said motor is mounted on the base and extends between the base and the collector to cause movement of the collector between the first and second positions of the collector.

Preferably, said base is suspended from said carriage so that the collector device is supported by the carriage.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
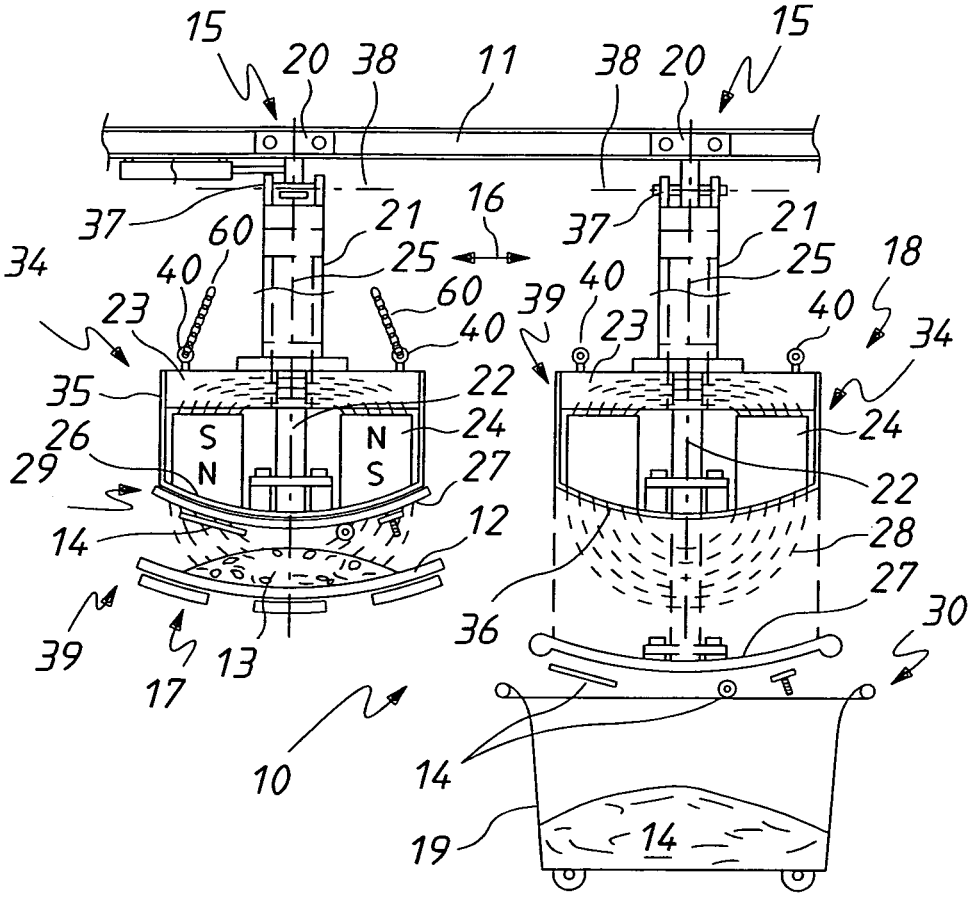
FIG. 1 is a schematic elevation of a suspension magnet assembly operatively associated with a conveyor belt and collection bin.

In the accompanying drawings there is schematically depicted a suspension magnet assembly 10. The assembly 10 includes a generally horizontally extending rail 11 located and supported above a conveyor belt 12 that conveys mined material 13. The mined material 13 may be contaminated with iron objects 14.

The assembly 10 includes a carriage 15 that is horizontally reciprocated in the direction 16 so as to be movable between a first position 17, located above the belt 12, and a second position 18 displayed laterally of the belt so that the collected material 14 may be deposited in a mobile bin 19.

The carriage 15 includes a wheeled frame 20 that provides for movement longitudinally along the rail 11. Attached to the frame 20 is a pneumatic or hydraulic cylinder 21 (motor) having a piston rod 22.

Connected to the cylinder 21 is a collector device 39, the device 39 includes a base 23 and a magnet 24. In this embodiment, magnet 24 at least partly surrounding the generally central longitudinal axis 25 of the cylinder 21. The magnet 24 has an arcuate lower surface 26.

The device 39 further includes a collector 27 supported by the piston rod 22. The collector 27 in this embodiment is a plate of non-magnetic material. The collector 27 has a lower downwardly convex surface and is preferably of a "dome" configuration so as to be downwardly convex. Preferably, the collector 27 (in transverse cross-section as shown in FIG. 1) is of an arcuate configuration that approximates the arcuate transverse configuration of the belt 12.

Preferably, the base 23 is formed of iron so as to partially complete the magnetic field 28.

By operation of the cylinder 25, the collector 27 is movable generally vertically between a first position 29 located adjacent the magnet 24, and a second position 30 spaced from the magnet 24 so that the collected material 14 falls from the collector 27 to be deposited in the bin 19.

Figure 2:
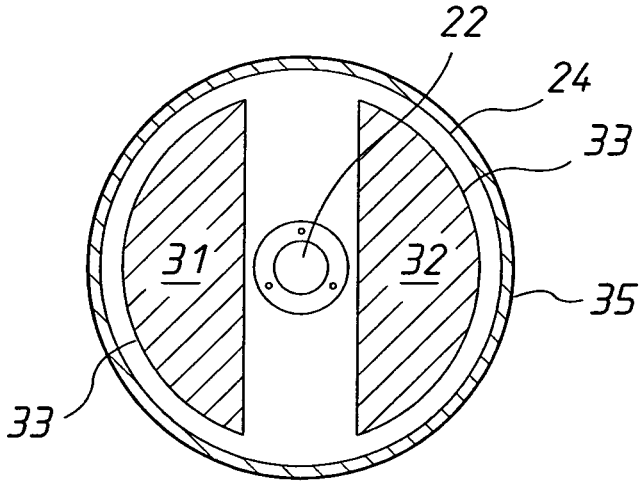
FIG. 2 is a schematic top plan view of portion of the suspension magnet assembly of FIG. 1.

In the above described preferred embodiment, the magnet 24 is a permanent magnet such as a ferrite or rare earth magnet. As best seen in FIG. 2, preferably the magnet 24 consists of two segments 31 and 32 which have peripheral side surfaces 33.

The segments 31 and 32 may be each formed from a plurality of smaller magnets' "stacked" to form a desired configuration including the lower arcuate surface 26. However in respect of the surface 26, a filler may be required, such as an iron powder and epoxy resin. The filler would need to be shaped to provide the desired configuration.

Preferably, the device 39 includes a housing 34. The magnet 24 is contained in a housing 34 and includes a cylindrical wall 35 and a lower plate 36. The plate 36 is arcuate so as to be of a domed configuration and convex downwardly. As an example, the plate 36 may be formed of stainless steel.

Preferably, the wheeled frame 20 supports the cylinder 21 by means of a pivot 37 that provides for angular movement about a generally horizontal axis 38, the axis 38 being generally perpendicular to the axis 25 and generally transverse relative to the longitudinal direction of extension of the belt 12.

Fixed to the base 23 are eyelets 40 via which the collector device 39 may be supported by means such as slings and/or chains 60. Slings and/or chains 60 are used to raise and lower the collector device 39 relative to the belt 12. The chains 60 are connected to the carriage 15 so as to support the base 23.

Figure 3:
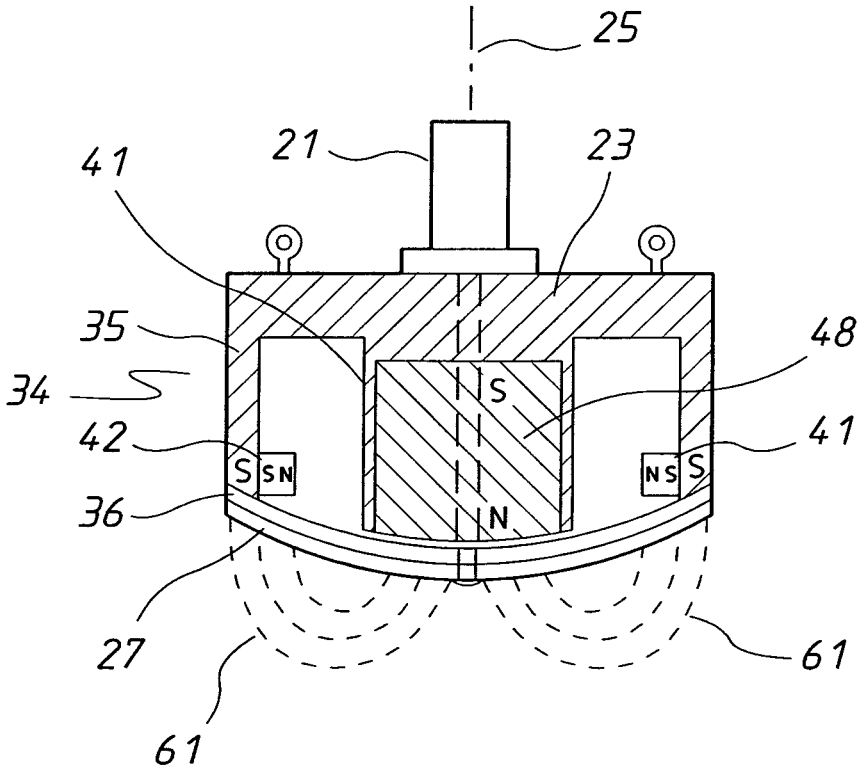
FIG. 3 is a schematic sectioned side elevation of a modification of portion of the assembly of FIG. 1.
Figure 4:
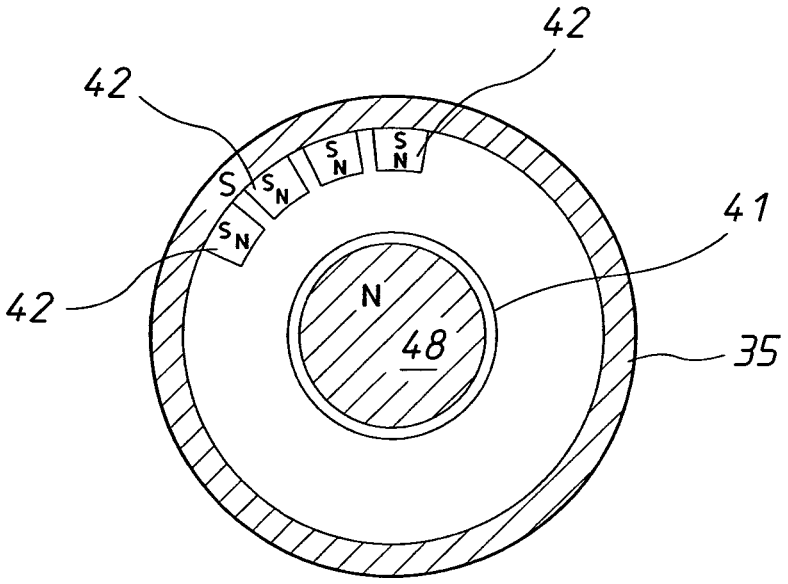
FIG. 4 is a schematic bottom plan view of the magnets arranged in the portion of FIG. 3.

In the embodiment of FIG. 3, there is provided a central magnet 48 that is arranged with a south pole at the top and north pole at the bottom. The magnet 48 is located in a cylindrical wall 41 of the housing 34. Adjacent the wall 35 is a plurality of magnets 42 that are preferably angularly spaced, and radially spaced from the wall 41. The magnets 42 are arranged so that each of the north poles is adjacent the magnet 48.

Figure 5:
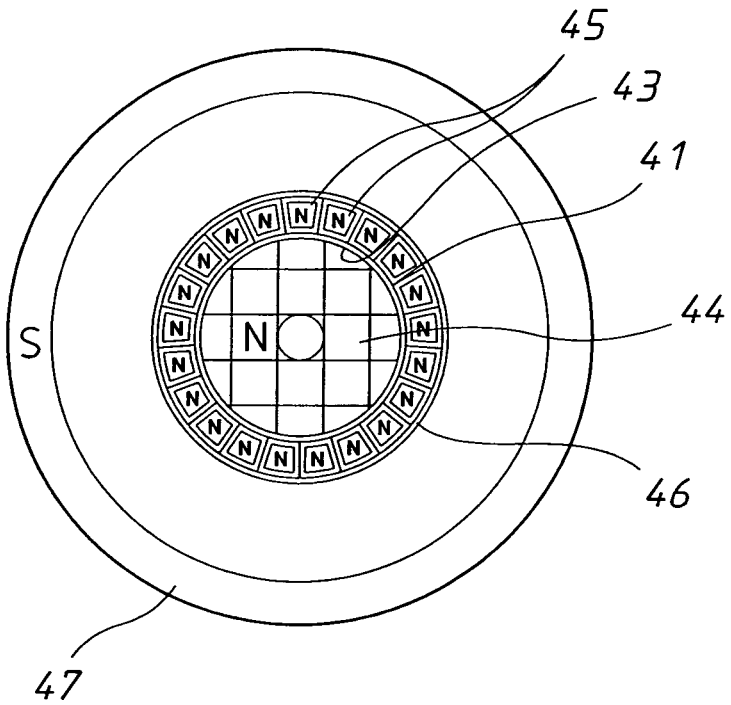
FIG. 5 is a schematic bottom plan of a modification of the magnets in FIG. 4.

In the embodiment of FIG. 5, housing 34 provides an inner cylindrical wall 43 surrounding a central magnet 44 having its north pole at the upper end. Surrounding the wall 44 is a plurality of magnets 45, each arranged to have its north pole upper. Surrounding the magnets 45 is a further cylindrical wall 46, the walls 41 and 46 being part of the housing 34. A further cylindrical wall 47 of the housing 34 surrounds the wall 46 and has an upper south pole.

Figure 6:
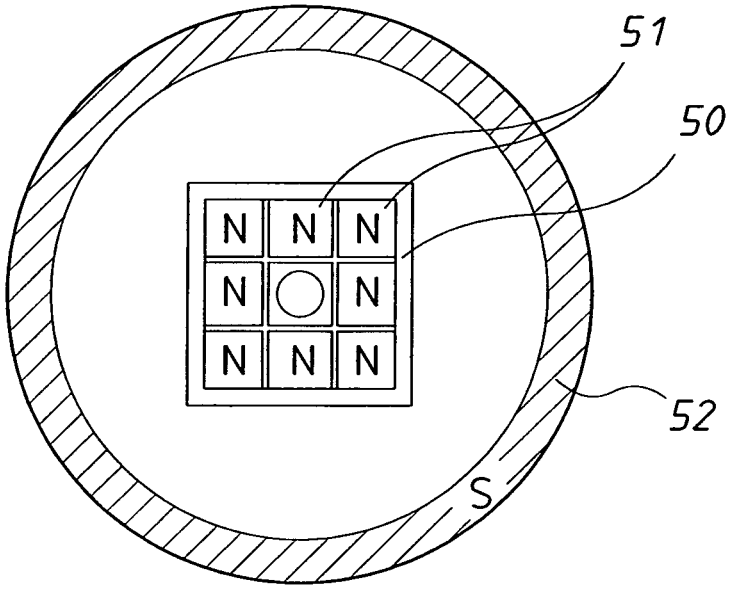
FIG. 6 is a schematic bottom plan view of a further modification of the magnets as shown in FIG. 4.

In the embodiment of FIG. 6, there is a central wall 50 (of square or rectangular in transverse cross-section) that surrounds a plurality of magnets 51. The magnets 51 have their north pole uppermost, while surrounding the wall 50 is a cylindrical magnet (wall) 52 having the south pole uppermost.

In the embodiment of FIG. 1, the magnet 31 has its north pole lowermost while the magnet 32 has its south pole lowermost so as to produce the field 28. In the embodiment of FIG. 3, the central magnet 48 has its north pole lowermost so as to produce the field 61.

In the above embodiments, the magnets are arranged about central longitudinal axis 25, with the axis 25 also passing centrally through the device 39, including the collector 27.

Figure 7:
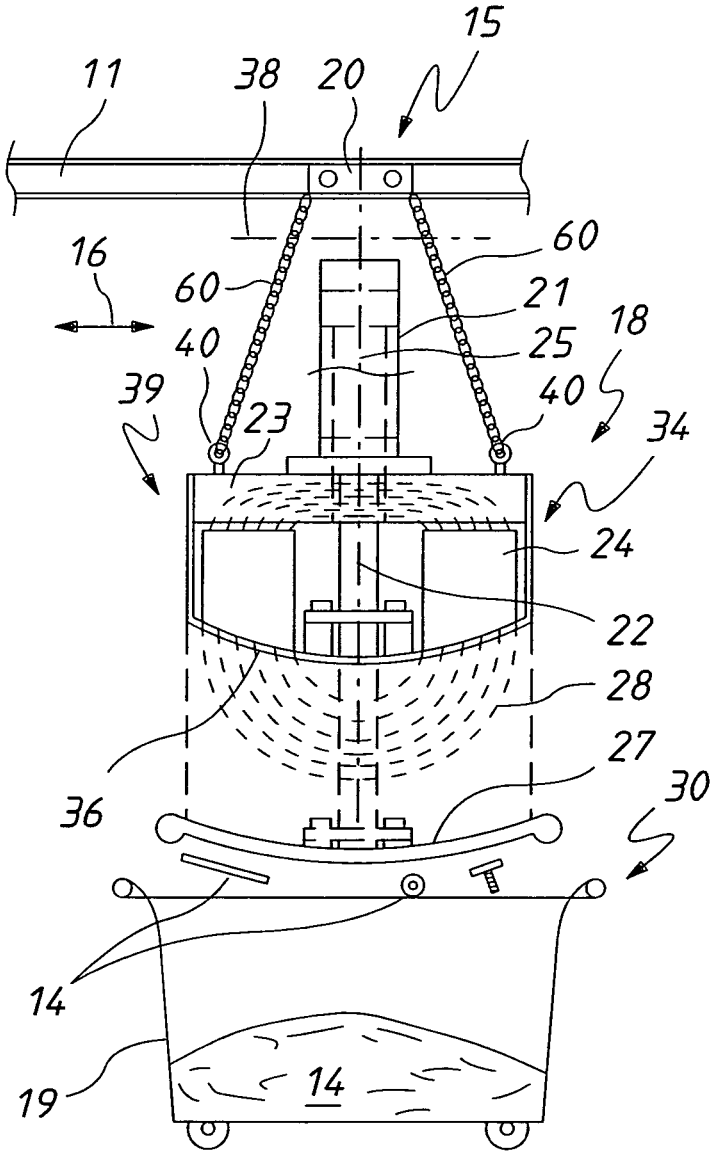
FIG. 7 is a schematic sectioned elevation of a modification of the assembly of FIG. 1.

In the embodiment of FIG. 7, the base 23 is solely supported by the chains or slings 60, with the cylinder 21 not directly coupled to the carriage 15. The cylinder 21 is directly coupled to the base 23 with the piston rod 22 extending through the base 23.

The invention claimed is:

1. A magnet assembly to collect iron from a conveyor belt, the assembly including:

a collector device including at least one magnet to be positioned adjacent the belt to collect iron therefrom, and wherein the collector device includes a collector having a downwardly convex arcuate surface to which the iron is attracted so as to be collected by the collector device, the collector being movable generally in a vertical direction between a first position adjacent to the at least one magnet and a second position spaced from the first position away from the at least one magnet.

2. The assembly of claim 1 further including:

a carriage movable between a first position and a second position;

the collector device is mounted on the carriage so as to move therewith, the collector device being supported so that when the carriage is in the first position the device is to be positioned adjacent the belt, while when located in the second position the collector device is to be spaced from the belt to provide for delivery of collected iron to a position spaced from the belt;

the collector is attached to the carriage and positioned relative to the at least one magnet so as to be locatable between the at least one magnet and the belt, the collector being essentially non-magnetic; and the collector device further includes:

a collector motor associated with the collector to cause movement of the collector between the first position where the collected iron is urged against the collector by the magnet so as to be retained by the assembly, and the second position where the collected iron is removed from the collector.

3. The assembly of claim 1 wherein the collector is of a domed configuration so as to be downwardly convex.

4. The assembly of claim 2 wherein said assembly includes a rail supporting said carriage, and a carriage motor operatively associated with the rail and carriage to cause movement of the carriage between the carriage first and second positions.

5. The assembly of claim 2 wherein said carriage is moved generally horizontally between the carriage first and second positions.

6. The assembly of claim 1 wherein the collector is located below the at least one magnet.

7. The assembly of claim 1 wherein the at least one magnet is a permanent magnet.

8. The assembly of claim 2 wherein the collector motor is generally centrally mounted so that the at least one magnet is arranged angularly about the collector motor.

9. The assembly of claim 8 wherein said assembly has a generally upright central longitudinal axis, about which the at least one magnet is angularly arranged, with said axis passing generally centrally through said arcuate surface.

10. The assembly of claim 2 wherein the collector device includes a base, the collector motor is mounted on the base and extends between the base and the collector to cause movement of the collector between the first and second positions of the collector.

11. The assembly of claim 10 wherein the base is suspended from said carriage so that the collector device is supported by the carriage.

12. The assembly of claim 2 wherein said collector is of a domed configuration so as to be downwardly convex.

13. The assembly of claim 12 wherein said assembly includes a rail supporting said carriage, and a carriage motor operatively associated with the rail and carriage to cause movement of the carriage between the carriage first and second positions.

14. The assembly of claim 13 wherein said carriage is moved generally horizontally between the carriage first and second positions.

15. The assembly of claim 14 wherein said collector is located below the at least one magnet.

16. The assembly of claim 15 wherein the collector motor causes movement of the collector in a generally vertical direction.

17. The assembly of claim 16 wherein the at least one magnet is a permanent magnet.

18. The assembly of claim 2 wherein the at least one magnet is a permanent magnet and the collector motor is generally centrally mounted so that the at least one magnet is arranged angularly about the collector motor.

19. The assembly of claim 18 wherein said assembly has a generally upright central longitudinal axis, about which the at least one magnet is angularly arranged, with said axis passing generally centrally through said arcuate surface, the collector device includes a base, the collector motor is mounted on the base and extends between the base and the collector to cause movement of the collector between the first and second positions of the collector, and the base is suspended from said carriage so that the collector device is supported by the carriage.

* * * * *